US006371998B1

(12) United States Patent
Mathur

(10) Patent No.: US 6,371,998 B1
(45) Date of Patent: Apr. 16, 2002

(54) LIPID VESICLE-BASED FUEL ADDITIVES AND LIQUID ENERGY SOURCES CONTAINING SAME

(75) Inventor: Rajiv Mathur, Sewell, NJ (US)

(73) Assignee: IGEN, Inc., Wilmington, DE (US)

( * ) Notice: Subject to any disclaimer, the term of this patent is extended or adjusted under 35 U.S.C. 154(b) by 0 days.

(21) Appl. No.: 09/602,732

(22) Filed: Jun. 26, 2000

Related U.S. Application Data

(63) Continuation of application No. 09/252,546, filed on Feb. 19, 1999, now Pat. No. 6,080,211.

(51) Int. Cl.[7] ..... C10L 1/18; C10L 1/32

(52) U.S. Cl. ..... 44/301; 44/389; 44/443; 44/388

(58) Field of Search ..... 44/301, 375, 386, 44/388, 389, 412, 436, 443, 451

(56) References Cited

U.S. PATENT DOCUMENTS

| | | | | |
|---|---|---|---|---|
| 4,059,411 | A | 11/1977 | Smith | 44/51 |
| 4,158,551 | A | 6/1979 | Feuerman | 44/51 |
| 4,307,012 | A | 12/1981 | Serres, Jr. | 260/45.95 |
| 4,499,267 | A | 2/1985 | Scifoni | 44/51 |
| 4,666,547 | A | 5/1987 | Hayes et al. | 44/51 |
| 4,793,826 | A | 12/1988 | Hayes et al. | 44/51 |
| 4,895,452 | A | 1/1990 | Yiornas | 366/173 |
| 4,911,928 | A | 3/1990 | Wallach | 424/450 |
| 4,618,348 | A | 5/1990 | Hayes et al. | 44/51 |
| 4,684,372 | A | 5/1990 | Hayes et al. | 44/51 |
| 5,090,966 | A | 2/1992 | Crawford et al. | 44/314 |
| 5,160,699 | A | 11/1992 | Wallach et al. | 264/4.3 |
| 5,433,757 | A | 7/1995 | Song et al. | 44/393 |
| 5,505,877 | A | 4/1996 | Krivohlavek | 252/314 |
| 5,643,600 | A | 7/1997 | Mathur | 424/450 |
| 5,669,938 | A | 9/1997 | Schwab | 44/301 |
| 5,725,609 | A | 3/1998 | Rivas et al. | 44/301 |
| 6,080,211 | A * | 6/2000 | Mathur | 44/301 |

* cited by examiner

*Primary Examiner*—Jacqueline V. Howard
(74) *Attorney, Agent, or Firm*—Lahive & Cockfield, LLP

(57) ABSTRACT

Liquid energy sources, e.g., liquid fuels comprising lipid vesicles having fuel additives such as water are disclosed herein. The liquid energy sources, methods for preparation, and methods of enhancing engine performance disclosed herein employing the lipid vesicles result in enhanced fuel efficiency and/or lowered engine emissions. The invention further relates to liquid energy sources containing such additives which further comprise a polymeric dispersion assistant, which reduces the interfacial tension and coalescence of vesicles during dispersion process and storage, and thereby provide transparent looks to the liquid energy source.

4 Claims, No Drawings

LIPID VESICLE-BASED FUEL ADDITIVES AND LIQUID ENERGY SOURCES CONTAINING SAME

This application is a continuation application of Ser. No. 09/252,546 filed on Feb. 19, 1999, now a U.S. Pat. No. 6,080,211. The contents of all of the aforementioned application(s) are hereby incorporated by reference.

BACKGROUND OF THE INVENTION

The present invention relates to liquid energy sources and in particular liquid energy sources comprising a liquid fuel and lipid vesicles containing a fuel additive such as water, which have enhanced performance characteristics compared to conventional gasoline and diesel fuels.

One recurring problem with existing commercial fuel is incomplete combustion, which results in higher emissions of nitrous oxide, carbon monoxide, hydrocarbons, and sulfur dioxide. It has previously been demonstrated that inclusion of up to 3% water in the fuel system reduces emissions of these gases and increases the octane rating.

One major problem with adding water and other aqueous components directly to liquid energy source, however, is that while the liquid energy source is capable of dispersing a limited amount of water, if too much water is present the water will separate out, along with other water soluble components of the liquid energy source. The separated water may cause damage to the engine and fuel systems by rusting and corroding metal parts.

In view of the problems of the current art, improved methods for incorporating water and other fuel additives in liquid energy source have been desired, as well as new liquid energy source compositions having the desired properties.

SUMMARY OF THE INVENTION

The present invention relates to liquid energy sources comprising a liquid fuel and lipid vesicles containing a fuel additive such as water, which have enhanced performance characteristics compared to conventional gasoline and diesel fuels. The present invention may be used to enhance the performance characteristics of conventional gasoline and diesel fuels, by reducing emissions of pollutants and increasing the octane rating.

The present invention features a liquid energy source containing a liquid fuel and lipid vesicles having at least one lipid bilayer formed from at least one wall former material, and which have at least one cavity containing a fuel additive. The fuel additive-containing lipid vesicles allow incorporation of fuel additives such as water or hydrazine in liquid energy sources more effectively and precisely than previously attainable. In an advantageous embodiment, the liquid energy source may also contain a polymeric dispersion assistant, which reduces the interfacial tension and coalescence of vesicles during dispersion process and storage, and thereby provide transparent looks to the liquid energy source. As such, in a preferred version of this embodiment, the addition of the polymer results in a transparent fuel. The polymer may be a polyoxyethylene glycol diester of polyhydroxy fatty acids represented generally by the following formula:

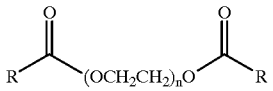

wherein RCO is a moiety derived from a polyhydroxy fatty acid and the value of n generally ranges between approximately 15 to approximately 40. In another embodiment the polymer is a polyoxyethylene glycol diester of fatty acids represented by the following general formula:

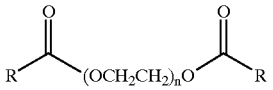

wherein RCO is a moiety derived from fatty acids such as, for example, stearic, palmitic, oleic, and lauric acids and n generally ranges between approximately 15 to approximately 40. In yet another embodiment, the polymer is a polyoxyethylene-polyoxypropylene block polymer represented by the following formula:

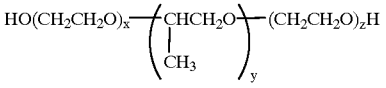

where the average value of x and the average value of z are each independently between about 2 and about 21 and the average value of y is between about 16 and about 67.

In another embodiment, the lipid vesicles have a cavity containing a fuel additive. The lipid vesicles may be paucilamellar, e.g., having 2–10 lipid bilayers surrounding an amorphous central cavity.

In yet another embodiment, the lipid vesicles are present in the liquid fuel in an amount sufficient to provide a concentration of the fuel additive (e.g., water) from about 0.01% to about 10%.

In a preferred embodiment, the liquid fuel is suitable for use in an internal combustion engine, e.g. gasoline or diesel fuel.

The invention also features a method for improving the efficiency of an internal combustion engine, by fueling the internal combustion engine with a liquid energy source containing a liquid fuel and lipid vesicles having at least one lipid bilayer formed from at least one wall former material and a at least one cavity containing a fuel additive. The liquid energy source may also desirably contain a polymeric dispersion assistant.

In another aspect, the invention features a method of reducing emissions from an internal combustion engine, by fueling said internal combustion engine with a liquid energy source comprising a liquid fuel and lipid vesicles comprising at least one lipid bilayer formed from at least one wall former material and a central cavity containing a fuel additive. The liquid energy source preferably also contains a polymeric dispersion assistant.

DETAILED DESCRIPTION OF THE INVENTION

The present invention relates to liquid energy sources comprising a liquid fuel and lipid vesicles containing a fuel additive such as water, which have enhanced performance characteristics compared to conventional gasoline and diesel fuels. The present invention may be used to enhance the performance characteristics of conventional gasoline and diesel fuels, e.g., by reducing emissions of pollutants and increasing the octane rating.

The present invention features a liquid energy source containing a liquid fuel and lipid vesicles which are comprised of at least one lipid bilayer formed from at least one wall former material.

The term "liquid fuel" includes fuels such as gasoline, diesel fuels, alternative fuels, bio-diesel, engineered fuels, kerosene, jet aviation fuels or mixtures thereof. In a preferred embodiment, the liquid energy source is suitable for an internal combustion engine.

The term "wall former material" includes lipids and sterols. Preferred wall former materials include non-ionic amphiphiles. In a preferred embodiment, the lipid bilayer is formed from at least a primary wall former. In an embodiment, the primary wall former is a non-ionic amphiphile. However, vesicles can be formed by blending these amphiphile with other amphiphile, which may or may not form vesicles or a lamellar phase on its own. Preferred other amphiphiles have like chain length and unsaturation but some variations are acceptable. The term "like chain length and unsaturation", as used herein, means and implies that both materials would have identical fatty add chains.

The wall former material present in the lipid bilayer(s), is desirably a non-ionic amphiphile, e.g., $C_{,12}$–$C_{18}$ fatty alcohols, polyoxyethylene acyl alcohols, block copolymers, polyglycerols, sorbitan fatty acid esters, ethoxylated $Cl_{12}$–$Cl_{18}$ glyceryl mono- and diesters, propylene glycol stearate, sucrose distearate, glyceryl dilaurate, glucosides, and mixtures thereof.

Inclusion of sterols in the construction of the vesicles of the present invention is believed to help buffer the thermotropic phase transition of the membrane layer, i.e., it enables the lipid membrane structure to be less susceptible to temperature changes in the region of the transition temperature. The sterols also insure optimal vesicle size and increase bilayer stability. Sterols include any sterol known in the art to be useful as modulators of lipid membranes. Suitable sterols include but are not limited to cholesterol, cholesterol derivatives, hydrocortisone, phytosterol, or mixtures thereof. In one embodiment, the sterol is phytosterol supplied from avocado oil unsaponifiables. The use of this sterol, in particular, to form lipid vesicles is described in U.S. application Ser. No. 08/345,223, entitled Lipid Vesicles Containing Avocado Oil Unsaponifiables, the contents of which are incorporated by reference herein.

In furher embodiment, the lipid bilayers may also contain a secondary wall former. The secondary wall former is preferably selected from the group consisting of quaternary dimethyl diacyl amines, polyoxyethylene acyl alcohols, sorbitan fatty acid esters and ethoxy sorbitan fatty acid esters.

In a further embodiment, the lipid bilayers may also contain a charge producing agent, e.g., dimethylstearyl amine, dicetyl phosphate, cetyl sulfate, phosphatidic acid, phosphatidyl serine, oleic acid, palmitic acid, stearylamines, oleylamines, and mixtures thereof.

In a particularly advantageous embodiment, the fuel additive and/or liquid energy source may contain a polymeric dispersion assistant. Often when a fuel additive is combined with the fuel, a cloudy mixture results, which is aesthetically undesirable and may lead the vendor or customer to conclude that the fuel is adulterated or spoiled. The liquid energy source containing the polymeric dispersion assistant is transparent. In one embodiment, the polymeric dispersion assistant may be a polyoxyethylene-polyoxypropylene glycol block polymer of the following formula:

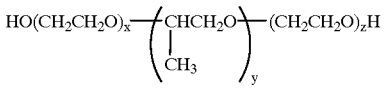

where the values of x, y, and z are each independently integers between about 1 and about 100. Preferably, the average value of x and the average value of z are each independently between about 2 and about 21 and the average value of y is between about 16 and about 67. In one advantageous embodiment, the average value of x and the average value of z are each independently about 3, and the average value of y is about 30. In another advantageous embodiment, the average value of x and the average value of z are each independently about 6, and the average value of y is about 39. In yet another advantageous embodiment, the average value of x and the average value of z are each independently about 7, and the average value of y is about 54.

In another embodiment, the polymeric dispersion assistant is a polyoxyethylene glycol diester of polyhydroxy fatty acids which can be represented generally by the following formula:

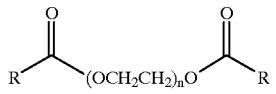

where RCO is a moiety derived from a polyhydroxy fatty acid and the value of n generally ranges between approximately 15 to approximately 40. Preferred examples of such moieties include, for example, PEG30 dipolyhydroxystearate.

In another embodiment the polymeric dispersion assistant is a polyoxyethylene glycol diester of fatty acids represented by the following general formula:

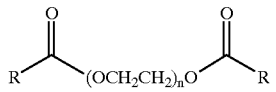

where RCO is a moiety derived from fatty acids such as, for example, stearic, palmitic, oleic, and lauric acids and n generally ranges between approximately 15 to approximately 40.

In a preferred embodiment, the lipid vesicles are paucilamellar lipid vesicles which are generally characterized as having two to ten lipid bilayers or shells with small aqueous volumes separating each substantially spherical lipid shell. Generally, the innermost lipid bilayer surrounds a large, substantially amorphous central cavity which may be filled with either an aqueous solution or other fuel additive such as noted herein. Alternatively, when the lipid vesicles are paucilamellar, multiple additives may be enclosed in each lipid bilayer shell so as to provide a blend of additives in the vesicle, e.g., a vesicle could comprise both water and kerosene, thus providing a more versatile fuel additive.

In one embodiment, the lipid vesicles are present in the liquid fuel in an amount sufficient to provide a concentration of the fuel additive in the range of from 0.01% to 10% of the fuel. In one particularly advantageous embodiment, the lipid vesicles are present in the liquid fuel (e.g., gasoline or diesel fuel) in an amount sufficient to provide a concentration of water in the liquid fuel of 5% or less, preferably 1.7% , and more preferably 3%.

The term "fuel additive" is art recognized and is intended to include compounds such as water, ethanol, hydrazine, hydrogen peroxide, and methyl isobutane ketone, soya methyl ester and mixtures thereof. In a particularly preferred embodiment, the fuel additive is water.

The invention also features a method of improving the efficiency of an internal combustion engine, by fueling the internal combustion engine with a liquid energy source containing a liquid fuel and lipid vesicles which have at least one lipid bilayer formed from at least one wall former material and a cavity containing a fuel additive.

In addition, the invention features a method of reducing emissions from an internal combustion engine, by fueling the internal combustion engine with a liquid energy source containing a liquid fuel and lipid vesicles which have at least one lipid bilayer formed from at least one wall former material and a cavity containing a fuel additive.

Aqueous filled vesicles, e.g., vesicles having their amorphous central cavities filled with a water-miscible solution, may be formed using either the "hot loading" technique disclosed in U.S. Pat. No. 4,911,928 or the "cold loading" technique described in U.S. Pat. No. 5,160,669, the disclosures of which are incorporated herein by reference. In either case, a lipid phase is formed by blending a primary wall former and compatible amphiphile(s),with or without sterols or lipophilic materials to be incorporated into the lipid bilayers, to form a homogenous lipid phase. In the "hot loading" technique, a lipophilic phase is made and heated, and is blended with a heated aqueous phase (e.g., water, saline, or any other aqueous solution which will be used to hydrate the lipids) under shear mixing conditions to form the vesicles. "Shear mixing conditions", as used herein, means a shear equivalent to a relative flow of 5–50 m/s through a 1 mm orifice. The paucilamellar lipid vesicles of the disclosure can be made by a variety of devices which provides sufficiently high shear for shear mixing. A device which is particularly useful for making the lipid vesicles of the present invention is described in U.S. Pat. No. 4,985,452, assigned to Micro Vesicular. Systems, Inc.

In the "cold loading" technique, the lipid phase and the aqueous phase are blended under shear mixing conditions to form vesicles. Once the substantially aqueous filled lipid vesicles are formed, they are combined with the "cargo" material to be encapsulated, e.g., the water immiscible material. Droplets of the water immiscible material enter the vesicles, presumably by a process resembling endocytosis. The cold loading method has been described in more detail in the aforementioned U.S. Pat. No. 5,160,669. These vesicles are then blended under low shear conditions, as described in U.S. Pat. No. 5,160,669.

Once the vesicles are formed, they are diluted with additional liquid energy source. If a polymer additive is also used, the polymer is added at this time. It is occasionally necessary to melt the polymer before incorporating it into the liquid energy source mixture.

The invention is further illustrated by the following Examples, which should not be construed as further limiting the subject of the invention. The contents of all references, issued patents, and published patent applications cited throughout this application including the background are hereby incorporated by reference.

EXAMPLE 1

In this Example, aqueous-filled vesicles were made using the methods disclosed in U.S. Pat. Nos. 5,160,669 and 4,911,928 from STEARETH-10, a polyoxyethylene-10 stearyl alcohol (ICI), glycerol distearate, cholesterol, mineral oil, oleic acid, methyl paraben, and propyl paraben. Briefly, the patent describes a technique whereby all of the lipid soluble materials are blended-together at elevated temperatures of 60°–80° C., but in some cases as high as 90° C. The aqueous phase, which includes all the water soluble materials is also heated. The lipid phase is then injected into an excess of the aqueous phase through a moderate shear device and the mixture is sheared until vesicles form. While a device such as the mixing machine shown in U.S. Pat. No. 4,895,452, the disclosure of which is incorporated herein by reference, may be used, a pair of syringes connected by a three way stopcock can provide shear sufficient for formation of the vesicles. The shear required is about 5–50 m/s through a 1 mm orifice. Further details of His process are described in U.S. Pat. No. 4,911,928. Table 1 lists the formula used to make the vesicles (A1).

TABLE 1

| Chemical Components | Mass (g) |
|---|---|
| Steareth-10 | 2.0 |
| Glycerol Distearate | 3.6 |
| Cholesterol | 1.0 |
| Mineral Oil | 1.0 |
| Oleic Acid | 0.5 |
| Water | 41.55 |
| Methyl paraben | 0.1 |
| Propyl paraben | 0.015 |

For these A1 vesicles, the aqueous solution was heated to 65° C., and the lipid soluble materials were heated to 72° C., before being mixed together in the method described above. The A1 vesicles that were formed were very small and spherical. The A1 vesicles were then mixed with gasoline in a ratio of 20 parts vesicles: 30 parts gasoline. Subsequently, the A1 vesicles were diluted to a concentration of about 50 ml of vesicles/liter of gasoline (0.5%).

The gasoline containing the A1 vesicles was tested in a small engine. A decrease in fuel consumption was noted when the gasoline containing the A1 vesicles was used.

When the mixture of gasoline and A1 vesicles were placed in a 45° C. oven for two weeks, the vesicles remained intact.

EXAMPLE 2

Using a similar procedure to that above, vesicles were made as follows.

TABLE 2

| | Mass of Vesicle Components (g) | | | | |
|---|---|---|---|---|---|
| Chemical | A2 | B2 | C2 | D2 | E2 |
| Steareth-10 | 2.0 | 1.5 | 1.5 | 1.0 | 1.0 |
| Glycerol Distearate | 3.6 | 2.7 | 2.7 | 1.8 | 1.8 |
| Mineral Oil | 1.0 | 0.75 | 0.75 | 0.5 | 0.5 |
| Phytosterol | 1.0 | 0.75 | 0 | 0.5 | 0 |
| Cholesterol | 0 | 0 | 0.75 | 0 | 0.5 |
| Oleic Acid | 0.5 | 0.375 | 0.375 | 0.25 | 0.25 |
| Water | 41.55 | 43.81 | 43.81 | 45.84 | 45.84 |
| Methyl paraben | 0.1 | 0.1 | 0.1 | 0.1 | 0.10 |
| Propyl paraben | 0.03 | 0.015 | 0.015 | 0.015 | 0.015 |

The lipids were at a temperature of 75° C. when mixed with the aqueous components, which were at a temperature of 650° C. The vesicles were cold loaded in a ratio of 20 parts vesicles to 30 parts gasoline, as before.

The "A2" vesicles were stable at 45° C. for a week in gasoline, although two layers were formed. However, after mixing, the layers dispersed.

The "B2" and "D2" vesicles had rod like structures, which contrasted to the spherical shape of the "C2" and "E2" vesicles.

EXAMPLE 3

Vesicles were made using a similar procedure as above, but incorporating soybean oil as a lipid component. The following table summarizes the chemical composition of the vesicles.

TABLE 3

| Chemical | Mass of Vesicle Components(g) | | |
|---|---|---|---|
| | A3 | B3 | C3 |
| Steareth-10 | 2.0 | 2.0 | 2.0 |
| Glycerol Distearate | 3.6 | 2.6 | 3.6 |
| Oleic Acid | 0.25 | 0.25 | 0.25 |
| Soybean Oil | 5.0 | 25.0 | 25.0 |
| Cholesterol | 1.0 | 1.0 | 0 |
| Water | 37.78 | 20.0 | 20.0 |
| Methyl paraben | 0.1 | 0.1 | 0.1 |
| propyl paraben | 0.015 | 0.015 | 0.015 |

The lipid components were at temperature of 720° C. and the aqueous components were at a temperature of 70° C. when mixed. All of the vesicles were small and spherical. They were each "cold loaded" with 20 parts vesicles: 30 parts gasoline.

Initially, the "A3" vesicles were white and separated into two layers within a half hour of being loaded. After three days, the "B3" vesicles had also separated into two layers. The "C3" vesicles, however, only had a small layer of gasoline separated out from the vesicles. After three days, all of the vesicles retained small spherical shapes.

EXAMPLE 4

In this trial, the amount of soybean oil was lowered from the amount in Example 3. The vesicles were made by the same procedure as outlined above. The following table summarizes the chemical composition of the vesicles.

TABLE 4

| Chemical | Mass of Vesicle Components (g) | | | | |
|---|---|---|---|---|---|
| | A4 | B4 | C4 | D4 | E4 |
| Steareth-10 | 2.0 | 2.0 | 2.0 | 2.0 | 2.0 |
| Glycerol Distearate | 3.6 | 2.6 | 3.6 | 3.6 | 3.6 |
| Oleic Acid | 0.25 | 0.25 | 0.25 | 0.25 | 0.25 |
| Soybean Oil | 20 | 15 | 10 | 0 | 5.0 |
| Water | 25.0 | 30.0 | 35.0 | 44.15 | 39.15 |

The aqueous components were at a temperature of 650° C., when mixed with the lipids, which were at a temperature of 720° C. The A4, B4, and C4 vesicles were all small and spherical. However, the "A4" batch had more irregular vesicles. After being mixed (20 parts vesicles: 30 parts gasoline) with gasoline, all the samples were stable, although some gasoline separated to the top in the C4, D4, and E4 batches. After one week, no degradation of the vesicles was noted.

EXAMPLE 5

A similar procedure was followed for making these vesicles. In these trials different levels of soya methyl ester was used to make the vesicles. The following table summarizes the composition of these vesicles.

TABLE 5

| Chemical | Mass of Vesicle Components (g) | | | |
|---|---|---|---|---|
| | A5 | B5 | C5 | D5 |
| Steareth-10 | 2.0 | 2.0 | 2.0 | 2.0 |
| Glycerol Distearate | 3.6 | 3.6 | 3.6 | 3.6 |
| Oleic Acid | 0.5 | 0.5 | 0.5 | 0.5 |

TABLE 5-continued

| Chemical | Mass of Vesicle Components (g) | | | |
|---|---|---|---|---|
| | A5 | B5 | C5 | D5 |
| Soya methyl ester | 2.5 | 25 | 12.5 | 15.0 |
| Water | 41.4 | 18.9 | 31.4 | 20.0 |

The aqueous components were at 65° C., when mixed with the 720° C. lipids to create the vesicles. All the vesicles were small and homogenous, although the A5 vesicles were very fluid while the B5 vesicles were very thick.

The A5 and C5 vesicles were cold loaded in gasoline at 40° C. The final concentration of vesicles in the fuel was 10%. For the A5 vesicles, no separation between the gasoline and the vesicles was noticed at room temperature, although at 45° C., there was a slight separation of a gasoline layer.

After the D5 vesicles were cold loaded at 450° C. (in a ratio of 50% gasoline, 50% vesicles), they were placed in an oven. After five days 25% of the gasoline had separated from the vesicle mixture.

EXAMPLE 6

In this trial, the amount of water incorporated into the vesicles was increased. The vesicles also comprised about 40% soya methyl ester. The vesicles were made following the procedure outlined above and the composition of each population of vesicles is outlined in Table 6 below.

TABLE 6

| Chemical | Mass of Vesicle Components (g) | | | |
|---|---|---|---|---|
| | A6 | B6 | C6 | D6 |
| Glyceryl Stearate | 0 | 20.0 | 0 | 20.0 |
| Steareth-10 | 3.2 | 0 | 3.2 | 0 |
| Glycerol Distearate | 5.76 | 0 | 5.76 | 0 |
| Oleic Acid | 0.80 | 0 | 0.80 | 0 |
| Soya methyl ester | 20.0 | 40.0 | 20.0 | 40.0 |
| POE20 Sorbitan Monooleate | 0 | 0 | 0.5 | 0.5 |
| Water | 20.0 | 40.0 | 19.5 | 39.5 |

The vesicles were created by shear mixing the lipid components (at a temperature of 70° C.) and aqueous components (at a temperature of 65° C.) together. The resulting vesicles were spherical. When 0.5 g of vesicles were mixed with 10 g of gasoline, the vesicles initially dispersed but then started to settle at the bottom.

EXAMPLE 7

In this trial, the vesicles were loaded into both diesel and gasoline. The formulation of the vesicles is outlined in Table 7 below.

TABLE 7

| Chemical | Mass of Vesicles Components (g) | | | |
|---|---|---|---|---|
| | A7 | B7 | C7 | D7 |
| Steareth-10 | 4.0 | 4.0 | 3.6 | 3.6 |
| Glycerol Distearate | 7.2 | 7.2 | 6.5 | 6.5 |
| Sorbitan Sesquioleate | 30 | 25 | 25 | 25 |
| Soya methyl ester | 5.0 | 5.0 | 25 | 45 |
| Water | 53.8 | 58.8 | 39.9 | 39.9 |

The vesicles were formed under shear mixing conditions with the aqueous components at a temperature of 650° C. and the lipid components at a temperature of 720° C.

The A7 and B7 vesicles were small, spherical and heterogeneous. When loaded into gasoline in a ratio of 20 parts vesicles: 80 parts gasoline, the A7 vesicles went into suspension easily and did not separate out.

The C7 and D7 vesicles were small, thick and homogenous. When loaded in gasoline (20 parts vesicles: 80 parts gasoline), the vesicles dispersed easily.

EXAMPLE 8

The gasoline containing the vesicles was tested using a 1995 Ford Explorer. The mileage was calculated from the first sputter of the engine to when the engine stopped completely. The tests were carried out during a range of outdoor temperatures. Table 8 below outlines the changes in gas mileage for the Explorer with the addition of various vesicles.

TABLE 8

| Type of Vesicle | % Water in Final Blend | Regular Gas Mileage (mpg) | Gas Mileage with Vesicles (mpg) | Difference in mileage per gallon | Percent Improvement |
|---|---|---|---|---|---|
| A1 | 1.70 | 19.2 | 19.7 | 0.5 | 2.6 |
| A1 | 1.70 | 19.2 | 19.8 | 0.6 | 3.1 |
| A1 | 1.70 | 19.2 | 22.3 | 3.1 | 16.1 |
| A2 | 2.20 | 16.1 | 15.6 | −0.5 | −3.1 |
| B2 | 1.70 | 16.1 | 17.3 | 1.2 | 7.4 |
| C2 | 1.70 | 16.1 | 17.9 | 1.8 | 11.2 |
| C3 | 0.80 | 16.1 | 16.7 | 0.6 | 3.7 |
| C3 | 1.57 | 16.1 | 16.7 | 0.6 | 3.7 |
| C7 | 1.70 | 16.1 | 17.3 | 1.2 | 7.4 |
| A7 | 1.70 | 16.1 | 16.4 | 0.3 | 1.9 |

In most cases, the addition of the lipid vesicles and the encapsulated additives to the gasoline resulted in increased mileage per gallon for the vehicle. The amount of water incorporated into the fuel does not uniformly affect the gasoline mileage. Although gas mileage was generally improved upon addition of the vesicles and the encapsulated additives, the emitted pollutants were significantly reduced as shown in Table 9 below.

TABLE 9

| Type of Vesicles | % $H_2O$ in gas | % CO | % Change | Hydrocarbons (ppm) | % Change | % $CO_2$ | % Change | % Oxygen |
|---|---|---|---|---|---|---|---|---|
| None | 0 | 0.25 | 0 | 85 | 0 | 16.9 | 0 | 0.0 |
| A1 | 1.70 | 0.02 | 92.0 | 7 | 93.0 | 19.8 | 17.2 | 0.0 |
| A1 | 2.20 | 0.0 | 100.0 | 2 | 98.0 | 15.27 | 9.6 | 0.0 |
| B2 | 1.70 | 0.0 | 100.0 | 11 | 87.0 | 14.49 | 14.3 | 0.0 |
| C3 | 0.80 | 0.01 | 96.0 | 10 | 88.0 | 15.1 | 10.7 | 5.4 |
| C3 | 1.57 | 0.03 | 88.0 | 8 | 91.0 | 14.62 | 13.5 | 0.0 |
| C7 | 1.70 | 0.0 | 100.0 | 3 | 96.0 | 15.22 | 9.9 | 0.0 |
| A7 | 1.70 | 0.04 | 84.0 | 50.0 | 41.0 | 14.73 | 12.8 | 0.0 |

This table shows that there was a significant reduction in emitted CO, when the vesicles were added to the gasoline. In the case of hydrocarbons, the A1, A7 and C3 vesicles and the additives encapsulated within significantly reduced the amount of hydrocarbons released in to the atmosphere. The reduction in the amount of hydrocarbons is an indication that the fuel was burning more efficiently. The amount of $CO_2$ was also reduced in all cases.

EXAMPLE 9

The mixtures of vesicles and gasoline in the above examples were cloudy. In an effort to ameliorate this condition in the gasoline, a polymeric dispersion assistant was added. The composition of the vesicles (A8) is shown in the table below.

TABLE 10

| Chemical Components | Mass (g) |
|---|---|
| Steareth-10 | 4.0 |
| Glycerol Distearate | 7.2 |
| Soya Methyl Ester | 5.0 |
| Sorbitan Sesquioleate | 5.0 |
| Water | 78.8 |

The A8 vesicles were formed under shear mixing conditions, as outlined in the procedure above.

The A8 vesicles were mixed with gasoline and polymer PEG-30 Dipolyhydroxystearate (1% A8 vesicles, 3% polymer). In order to disperse the polymer through out the mixture, it was necessary to melt the polymer first. In a second trial, 1% A8 vesicles and 2% polymer was used. After the polymer was melted, it dispersed easily, which resulted in a clear solution of the gasoline. When no polymer was used, the resulting mixture of gasoline and vesicles was a hazy suspension.

The A8 vesicles were also mixed with diesel fuel. In the first trial, 0.5% of the A8 vesicles were mixed with 3.0% PEG-30 dipolyhydroxystearate polymer. The mixture became clear yellow after extensive mixing. In the second trial, the melted polymer (2% by weight) was added directly to the diesel fuel (97% by weight). The polymer dispersed easily. Then, the A8 vesicles (2% by weight) were added, resulting in a cloudy mixture. When the mixture was shaken, it became clear. When no polymer was used, the resulting mixture of diesel fuel and vesicles resulted in a hazy yellow suspension.

EXAMPLE 10

In another demonstration of the benefits of admixing vesicles of the invention in liquid energy source to reduce emissions, A8 vesicles were prepared as in Example 9, mixed with gasoline and tested as follows.

The A8 vesicles were gently mixed with gasoline (Indolene), followed by gentle mixing in of PEG-30 Dipolyhydroxystearate (2.2% A8 vesicles, 4.4% PEG30) to form a Blend 1. A Blend 2 was similarly formed, using 6.6% polyoxyethylene-polyoxypropylene glycol block polymer in place of the PEG30.

A 1997 Chevrolet Lumina was subjected to Hot 505 Emissions testing, using a control fuel (Indolene), and Blends 1 and 2. The results are shown in Table 11, below. The data show the dramatic reduction in emissions, e.g., CO and NOx, provided by addition of the vesicles of the invention.

TABLE 11

| Fuel | THC | NMHC | CO | $NO_x$ | $CO_2$ | MPG |
|---|---|---|---|---|---|---|
| Indolene (Control) | 0.08 g/mi | 0.062 g/mi | 1.056 g/mi | 0.192 g/mi | 335.477 g/mi | 26.22 |
| Blend 1 (% change from control) | 0.117 g/mi (34.50%) | 0.090 g/mi (45.00%) | 0.752 g/mi (−28.80%) | 0.082 g/mi (−57.30%) | 336.562 g/mi (0.323%) | 26.16 (−0.23%) |
| Blend 2 (% change from control) | 0.094 g/mi (8.00%) | 0.066 g/mi (6.40%) | 0.322 g/mi (−69.50%) | 0.069 g/mi (−64.00%) | 336.432 g/mi (0.285%) | 26.23 (0.04%) |

EQUIVALENTS

Those skilled in the art will recognize, or be able to ascertain using no more than routine experimentation, numerous equivalents to the specific procedures described herein. Such equivalents are considered to be within the scope of this invention and are covered by the following claims. The contents of all references, issued patents, and published patent applications cited throughout this application are hereby incorporated by reference.

What is claimed is:

1. A liquid energy source comprising a liquid fuel and lipid vesicles, wherein said lipid vesicles comprise about, 4% by weight of polyoxyethylene-10-stearyl alcohol about 7.2% by weight of glycerol distearate, about 5.0% by weight of soya methyl ester, about 5.0% by weight of sorbitan sesquioleate, and about 78.8% by weight water.

2. The liquid energy source of claim 1, wherein said liquid fuel is gasoline, diesel fuels, bio-diesel, kerosene, jet aviation fuel, or a mixture thereof.

3. The liquid energy source of claim 1, wherein said liquid fuel is indolene.

4. The liquid energy source of claim 1, further comprising a polymeric dispersion assistant.

* * * * *